US011420657B2

(12) United States Patent
Muhr et al.

(10) Patent No.: US 11,420,657 B2
(45) Date of Patent: Aug. 23, 2022

(54) LEVELLING SYSTEM FOR A VEHICLE, IN PARTICULAR A RAIL VEHICLE

(71) Applicant: KNORR-BREMSE SYSTEME FÜR SCHIENENFAHRZEUGE GMBH, Munich (DE)

(72) Inventors: Jürgen Muhr, Grafrath (DE); Ulrich Wermund, Munich (DE); Eduard Nies, Puchheim (DE); Mark A. Sterrett, Hanover, PA (US)

(73) Assignee: KNORR-BREMSE SYSTEME FÜR SCHIENENFAHRZEUGE GMBH

( * ) Notice: Subject to any disclaimer, the term of this patent is extended or adjusted under 35 U.S.C. 154(b) by 16 days.

(21) Appl. No.: 16/763,190

(22) PCT Filed: Sep. 17, 2018

(86) PCT No.: PCT/EP2018/075016
§ 371 (c)(1),
(2) Date: May 11, 2020

(87) PCT Pub. No.: WO2019/091638
PCT Pub. Date: May 16, 2019

(65) Prior Publication Data

US 2020/0361500 A1 Nov. 19, 2020

(30) Foreign Application Priority Data

Nov. 9, 2017 (EP) ..... 17200882

(51) Int. Cl.
*B61F 5/22* (2006.01)
*B61F 1/14* (2006.01)
*F15B 15/14* (2006.01)

(52) U.S. Cl.
CPC ..... *B61F 5/22* (2013.01); *B61F 1/14* (2013.01); *F15B 15/1414* (2013.01); *F15B 15/1471* (2013.01)

(58) Field of Classification Search
CPC ..... B61F 1/14; B61F 5/22; B61F 5/24; B61F 5/245; F15B 15/1414; F15B 15/1471; F15B 15/24
See application file for complete search history.

(56) References Cited

U.S. PATENT DOCUMENTS 3,279,755 A * 10/1966 Notenboom ..... F15B 15/1414 254/93 R
3,313,215 A 4/1967 Bieri
(Continued)

FOREIGN PATENT DOCUMENTS

AT 411349 B 12/2003
CZ 16146 U1 1/2006
(Continued)

OTHER PUBLICATIONS

International Search Report and Written Opinion corresponding to PCT/EP2018/075016, dated Jan. 21, 2019.

*Primary Examiner* — Abiy Teka
*Assistant Examiner* — Matthew Wiblin
(74) *Attorney, Agent, or Firm* — Barnes & Thornburg LLP

(57) ABSTRACT

A levelling system for a vehicle, in particular a rail vehicle, includes at least one levelling cylinder and a levelling piston. The levelling piston is at least partially provided in the levelling cylinder in a movable manner for setting the level of the rail vehicle. Further, the levelling system includes at least one guiding element, which is arranged within the levelling piston and partially protrudes from the levelling piston into at least one recess of the levelling cylinder such
(Continued)

that an end stop in a longitudinal direction is provided for the relative movement between the levelling piston and the levelling cylinder.

9 Claims, 3 Drawing Sheets

(56) References Cited

U.S. PATENT DOCUMENTS

| | | | | |
|---|---|---|---|---|
| 3,631,765 | A * | 1/1972 | Neumeister | F15B 15/1414 92/52 |
| 9,315,203 | B2 | 4/2016 | Franks | |
| 2005/0029064 | A1* | 2/2005 | Gaile | B60G 17/056 188/322.21 |
| 2006/0196354 | A1 | 9/2006 | Garcia et al. | |
| 2007/0035103 | A1* | 2/2007 | Anton | F16F 3/10 280/124.16 |
| 2015/0021445 | A1* | 1/2015 | Franks | B61F 5/02 246/218 |

FOREIGN PATENT DOCUMENTS

| | | | |
|---|---|---|---|
| DE | 29606024 | U1 | 6/1996 |
| DE | 102015202118 | A1 | 8/2016 |
| JP | 2010076608 | A | 4/2010 |
| WO | 2011032850 | A1 | 3/2011 |

* cited by examiner

LEVELLING SYSTEM FOR A VEHICLE, IN PARTICULAR A RAIL VEHICLE

CROSS REFERENCE AND PRIORITY CLAIM

This patent application is a U.S. National Phase of International Patent Application No. PCT/EP2018/075016 filed Sep. 17, 2018, which claims priority to European Patent Application No. 17200882.3, the disclosure of which being incorporated herein by reference in their entireties.

FIELD

Disclosed embodiments provide a levelling system for a vehicle, in particular a rail vehicle, comprising at least one levelling cylinder and a levelling piston. The levelling piston is at least partially provided in the levelling cylinder in a movable manner for setting the level of the rail vehicle.

BACKGROUND

Levelling systems for rail vehicles, are known, by which the height between the chassis and the vehicle body for regulating the level of the vehicle body of the rail vehicle can be adjusted.

SUMMARY

Disclosed embodiments provide an advantageous levelling system for a vehicle, in particular a levelling system, which provides a space-saving assembly, enables an adjustment of the level of the vehicle as well as allows an efficient assembling and maintenance.

BRIEF DESCRIPTION OF THE FIGURES

Further details and advantages of the disclosed embodiments will be outlined in reference to examples as illustrated in the figures as follows.

DETAILED DESCRIPTION

Figure 1:
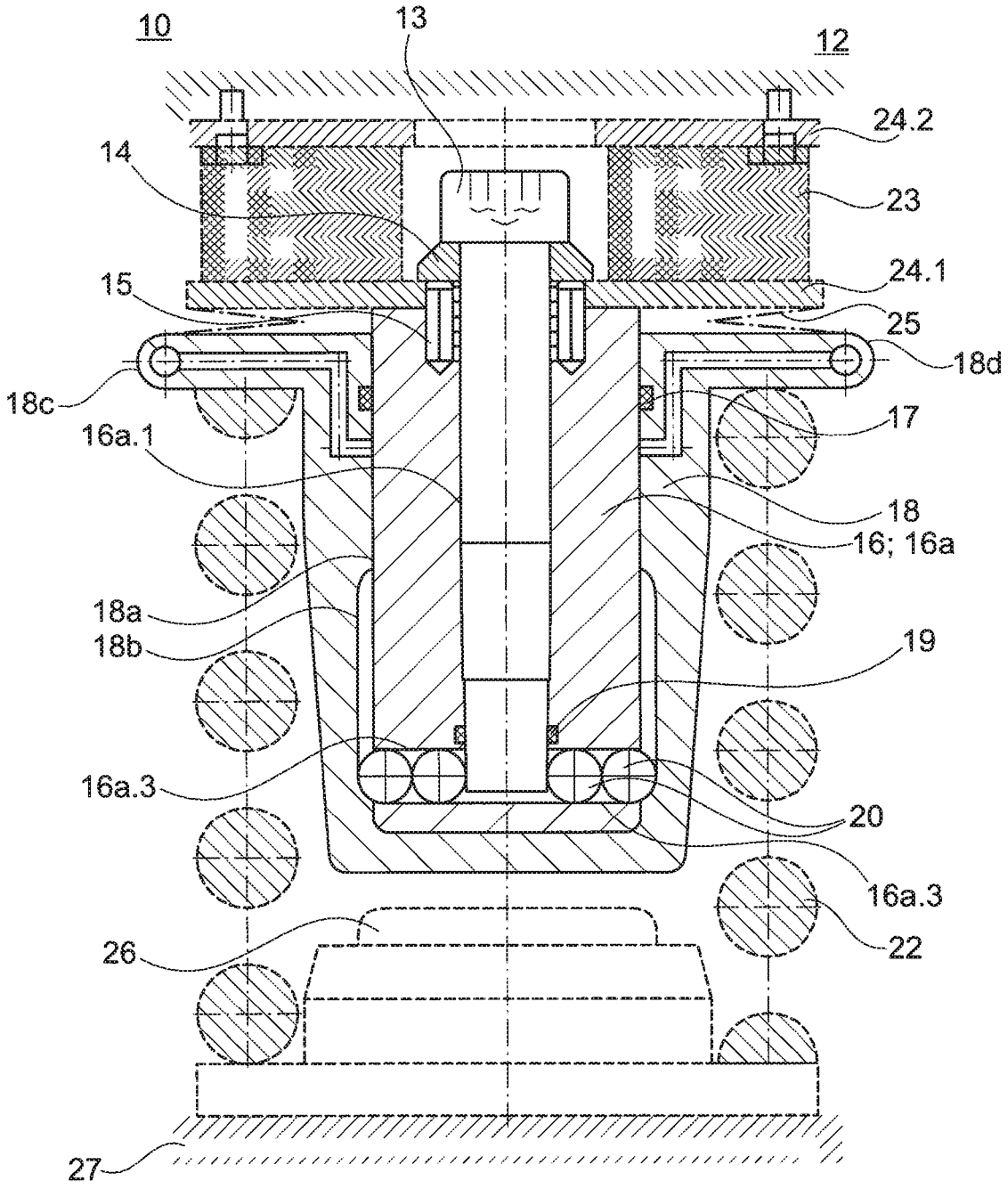
FIG. 1 a sectional view of a first embodiment of the levelling system according to the disclosed embodiments in a retracted state.

Levelling systems for rail vehicles, are known, by which the height between the chassis and the vehicle body for regulating the level of the vehicle body of the rail vehicle can be adjusted.

Prior art DE 103 15 000 A1 discloses a rail vehicle with a substructure and a car body, wherein a spring stage is provided between the substructure and the car body, wherein at least one actuator is provided between the substructure and the car body with the actuator being arranged to force the car body from a higher driving position into a lower loading/unloading position against a restoring force, wherein the car body is lifted into the driving position by the restoring force when the actuator is deactivated.

Further, U.S. Pat. No. 9,315,203 B2 shows a levelling system for a rail vehicle, which is able to lift the car body of the rail vehicle by hydraulic cylinders. The hydraulic cylinders are connected to the chassis of the rail vehicle.

In accordance with the disclosed embodiments, a levelling system for a vehicle, in particular a rail vehicle, comprises at least one levelling cylinder and a levelling piston, wherein the levelling piston is at least partially provided in the levelling cylinder in a movable manner for setting the level of the rail vehicle. The levelling system comprises at least one guiding element, which is arranged within the levelling piston and partially protrudes from the levelling piston into at least one recess of the levelling cylinder such that an end stop in longitudinal direction is provided for the relative movement between the levelling piston and the levelling cylinder.

Disclosed embodiments are based on the basic idea that the assembly of a levelling system can be simplified as well as optimized in its functionality by an integrated construction of the levelling cylinder and the levelling piston.

In particular, a space-saving construction as well as realization of functional features is achievable. For example, an integrated limitation of relative movement between the levelling cylinder and the levelling piston can be provided. Therefore, geometrical properties are directly included in the geometrical construction of the levelling cylinder and/or the levelling piston.

Moreover, also occurring forces can easily and efficiently be handled by providing form fits between components of the levelling system and enabling relative movements among the components solely in specific directions as necessary. Not only a protection but also a strengthening of the levelling system against undesired forces, such as shear forces, is achieved.

Consequently, the advantages of a levelling system according to the disclosed embodiments are not only noticeable during the run time of the levelling system but also in the course of the manufacturing and assembly as well as the maintenance of the system, particularly in terms of a simplified handling.

According to disclosed embodiments, the levelling piston is at least partially provided in the levelling cylinder in a movable manner for setting the level of the rail vehicle.

The levelling piston is movably arranged within the levelling cylinder, according to a usual lift cylinder.

Disclosed embodiments may provide a levelling cylinder as a hydraulically operable levelling cylinder.

In a retracted state of the levelling system, the levelling piston may be completely arranged within the levelling cylinder. Alternatively, the levelling piston is at least partially arranged within the levelling cylinder.

In an extended state of the levelling system, the levelling piston is partially arranged within the levelling cylinder. Thus, a stroke between the retracted and the extended state of the levelling system is provided.

Further, the levelling system may include at least one guiding element, which is arranged within the levelling piston and partially protrudes from the levelling piston into at least one recess of the levelling cylinder such that an end stop in longitudinal direction is provided for the relative movement between the levelling piston and the levelling cylinder.

The at least one guiding element is mainly arranged inside the levelling piston. In this context, the guiding element is carried by the levelling piston.

By the at least one guiding element partially protruding from the levelling piston, at least a temporary contact between the at least one guiding element and the levelling cylinder is achievable in the course of a relative movement between the levelling piston and the levelling cylinder.

In the context of the disclosed embodiments, a single guiding element can also consist of two or more elements, i.e., two balls, pins or the like.

According to the disclosed embodiments, the protrusion of the guiding element intrudes into the recess of the levelling cylinder.

The guiding element is arranged in the levelling piston and protrudes into the recess of the levelling cylinder in such a manner that a relative movement of the levelling piston and the levelling cylinder is limited by the guiding element and the recess.

Optionally, the levelling piston and the levelling cylinder can move relative to each other in such a way that the guiding element and the recess can move relative to each other.

In particular, a translational movement of the levelling piston, in a longitudinal direction of the levelling system, can be limited by the length of the recess along the inner diameter of the levelling cylinder.

According to the design of the at least one recess, also a rotational movement between the levelling piston and the levelling cylinder can optionally be avoided. This effect can be achieved if the recess comprises a geometry which directly corresponds to the protruding geometry of the guiding element, i.e. the part of the guiding element which protrudes from the levelling piston.

Alternatively, depending on an appropriate design of the recess, the rotational movement of the levelling piston can be restricted to a certain degree as well. Thus, also a progressively changing geometry of the recess is conceivable in order to progressively impede, e.g., a rotational movement along an increasing rotation of the levelling piston.

The same may apply to a translational movement in the longitudinal direction of the levelling cylinder.

Along an inner diameter of the levelling cylinder, in which the levelling piston is arranged, the levelling cylinder comprises the at least one recess.

In case of multiple guiding elements being provided, the levelling cylinder can comprise a corresponding amount of recesses which are equally distributed along the circumference of the inner diameter of the levelling cylinder. In consequence, each guiding element can be assigned to a single recess.

Alternatively, multiple guiding elements can be provided in combination with a single recess of the levelling cylinder, wherein the single recess corresponds to a circumferential extension of the inner diameter of the levelling cylinder.

In this case, a rotational movement of the levelling piston cannot be prevented by the guiding elements in combination with the single, circumferential recess.

In consequence, disclosed embodiments are capable of providing a simplified as well as effective embodiment of a levelling system by an integral construction, particularly including a guiding function which limits the relative movement between the levelling cylinder and the levelling piston in order to provide an appropriate stroke movement of the levelling system.

According to another embodiment, the at least one recess of the levelling cylinder is formed as a groove extending on an inner diameter of the levelling cylinder and along a part of the longitudinal extension of the levelling cylinder.

Thus, the recess in terms of a groove is only provided over a certain length of the inner diameter of the levelling cylinder. In this regard, the length of the recess or groove limits the stroke of the levelling system.

Optionally, the at least one groove of the levelling cylinder comprises a geometry which corresponds to the protruding guiding element, in particular the part of the respective guiding element which protrudes from the levelling piston.

In this way, an appropriate translational movement of the levelling piston relative to the levelling cylinder is provided, wherein a translational movement may be prevented.

In consequence, the advantage is achieved that the movement of the levelling system is limited by an integrally provided and simply designed form fit.

The form fit for movement limitation is provided by the levelling cylinder including the at least one recess or groove, the guiding element as well as the levelling piston which carries the guiding element in an appropriate manner.

According to another embodiment, the levelling piston comprises a central hole which is formed such that the at least one guiding element is able to pass through.

In particular, the central hole of the levelling piston corresponds to the guiding element such that the guiding element can easily be introduced into the levelling piston.

Optionally, the central hole of the levelling piston can be provided with an internal screw thread.

Further, the levelling piston optionally comprises at least one receiving hole in which the guiding element is received and positioned to protrude form the levelling piston into the recess of the levelling cylinder.

The receiving hole can be provided as a through hole in the levelling piston which is orthogonally oriented in relation to the longitudinal direction of the levelling piston.

Alternatively, the receiving hole may be connected to the central hole by any other embodiment of an appropriate channel in order to allow the guiding element to pass from the central hole of the levelling piston to the receiving hole.

Further the at least one receiving hole for a guiding element can be provided at a desired height of the levelling piston, wherein the position in the levelling piston may correspond with the position of the recess or grooves at the inside of the levelling cylinder.

Finally, the central hole of the levelling piston functions as an entrance for the at least one guiding element as well as a fixation means for fixing the levelling piston to a vehicle or the like.

According to another embodiment, the levelling piston comprises a piston and a piston plug, wherein the plug is arranged within the piston.

Optionally, the piston plug is completely introduced into the plug hole of the piston to form the levelling piston.

The levelling piston can be provided as two separate parts which can be fitted together in the course of the assembly of the levelling system.

In consequence, various solutions to realize, e.g., the at least one receiving hole for at least one guiding element can be provided as an integrated construction.

According to another embodiment, the piston comprises a plug hole at a longitudinal end side such that the piston plug is insertable into the piston.

In particular, by introducing the piston plug into the plug hole, the at least one receiving hole of the piston may be at least partially closed such that a form fit between the piston, the piston plug, the guiding element and the recess or groove of the levelling cylinder is achieved which solely enables a certain direction of relative movement of the levelling piston.

Finally, the levelling piston made of multiple parts, in particular the piston with a plug hole and the piston plug, offers several options of geometrical solutions to provide adequate and suitable handling of the guiding element in the context of the disclosed embodiments.

According to another embodiment, the piston plug comprises at least a first outer circumference and a second outer circumference.

In particular, the piston plug comprises varying diameters along its longitudinal extension. Optionally, the first outer circumference is smaller than the second outer circumference.

The first and second outer circumferences of the piston plug are introduced into corresponding sections of the plug hole of the piston.

According to another embodiment, the at least one guiding element is provided between the piston of the levelling piston and the second outer circumference of the piston plug such that the guiding element protrudes at least partially from the levelling piston into the recess of the levelling cylinder.

The second outer circumference or diameter is particularly provided to at least partially close the receiving hole of the piston.

Thus, the second outer circumference is used to achieve a form fit between the guiding element inside the receiving hole and the recess or groove of the levelling cylinder.

In consequence, by inserting the piston plug into the plug hole of the piston, the guiding element is forced into its intended position for the use of the levelling system.

According to another embodiment, the piston plug comprises an inclined chamfer, which forms a transition area between the first and second outer circumference.

Thus, an appropriate transition between the first and second outer circumference of the piston plug is achieved, which may help to appropriately arrange the guiding element in the corresponding receiving hole during assembly of the levelling system.

Further, the chamfer enables the piston plug to be tightly fitted into the plug hole of the piston.

In particular, the guiding element can be introduced into the piston of the levelling piston through the central hole, while the piston plug is only partially introduced into the plug hole. In consequence, the space between the piston and the partially introduced piston plug connects an end of the central bore with the at least one receiving hole.

By introducing a guiding element into the central hole of the piston, the guiding element can pass through the space between the piston and the piston plug such that the guiding element is transferable into the receiving hole.

By completely inserting the piston plug into the plug hole of the piston, the receiving hole is at least partially closed by the second outer circumference of the piston plug in such a way that the guiding element is appropriately positioned in the receiving hole.

According to another embodiment, the at least one guiding element is provided as a ball or a pin.

Thus, the guiding element is provided in a manner to be capable of being transferred through the central hole of the piston to the receiving hole.

Thereby, the guiding element can comprise common geometries which allow to provide a movement limitation within the levelling system in order to provide a specific and preassigned stroke.

In consequence, an advantageously simplified assembly by an integrated construction of the levelling cylinder, the levelling piston as well as the at least one guiding element is provided according to the disclosed embodiments.

Moreover, the guiding element may form a part of an longitudinal end stop for limitation of the stroke movement and/or a rotation lock for the levelling system.

FIG. 1 shows a sectional view of a first embodiment of a levelling system 10 in a retracted state.

The levelling system 10 comprises a levelling cylinder 18 and a levelling piston 16, which is formed by a piston 16*a* and guiding elements 20.

The levelling piston 16 is at least partially provided in the levelling cylinder 18.

In particular, the levelling cylinder 18 comprises an inner diameter 18*a* in which the levelling piston 16 is arranged in a movable manner.

Consequently, the inner diameter 18*a* of the levelling cylinder 18 is correspondingly formed with the levelling piston 16 such that a suitable relative movement of the levelling piston 16 is possible.

Furthermore, according to FIG. 1, the levelling system 10 is illustrated in connection with a car body 12, in particular a rail vehicle body 12, on one side and in connection with a bogie 27 on the other side.

In connection with the bogie 27, there is a bump stop 26 around which a coil spring 22 is positioned.

The coil spring 22 extends in the direction towards the rail vehicle body 12 and thereby surrounds the levelling cylinder 18 partially.

According to FIG. 1 the levelling cylinder 18 comprises a first hydraulic port 18*c* and a second hydraulic port 18*d*.

Thereby, the first and second hydraulic ports 18*c*; 18*d* can also be integrally formed with a collar of the levelling cylinder 18.

The first hydraulic port 18*c* can be used as an inlet for a hydraulic fluid, while the second hydraulic port 18*d* can be used as an outlet or a bleed valve. Alternatively, the first and second hydraulic port 18*c*; 18*d* can be used vice versa as well.

The first and second hydraulic ports 18*c*; 18*d* are arranged at the levelling cylinder in a tangential manner. Alternatively, both or only one of the hydraulic ports 18*c*; 18*d* can be formed with the levelling cylinder 18 in an orthogonal manner.

In particular, the first and second hydraulic ports 18*c*; 18*d* are integrally formed with the levelling cylinder 18.

The coil spring 22 extends against the collar of the levelling cylinder 18.

On the opposite side of the collar of the levelling cylinder 18, a bellow 25 is provided which extends against a first fixation washer 24.1.

Between the fixation washer 24 and the rail vehicle 12, there is a ring-shaped layer spring 23.

The ring-shaped layer spring 23 extends against a second fixation washer 24.2, which is fixed to the rail vehicle body 12 by screws, pins, bolts or the like.

The first and second fixation washer 24.1; 24.2 are provided with centered through holes according to FIG. 1.

The first and second hydraulic ports 18*c*; 18*d* also comprise respective fluid channels which lead to the inner diameter 18*a* of the levelling cylinder 18.

In this regard, it is possible that the inner diameter 18*a* of the levelling cylinder 18 and/or the circumferential surface of the piston 16*a* comprise(s) suitable fluid grooves or the like to allow the hydraulic fluid to be transferred and dispersed between the directly opposing surfaces of the levelling cylinder 18 and the piston 16*a*.

Along the inner diameter 18*a* of the levelling cylinder 18, a cylinder seal 17 is provided.

In particular, the cylinder seal 17 is provided relative to the fluid channels of the first and second hydraulic ports 18*c*; 18*d* in order to seal the levelling cylinder against the surrounding atmosphere.

Consequently, hydraulic fluid from the inside of the inner diameter 18*a* of the levelling cylinder 18 cannot leak out along the opposing surfaces of the levelling cylinder 18 and the levelling piston 16 or the piston 16*a* because of the cylinder seal 17.

Furthermore, the opposing surface of the inner diameter 18*a* of the levelling cylinder 18 and the piston 16*a* can be considered as contact or sliding surfaces.

Optionally, at least one guide band or slip band (not shown in FIG. 1) can be provided around the respective surface of the piston 16*a* in order to provide a suitable bearing inside the inner diameter 18*a* of the levelling cylinder 18.

The piston 16*a* of the levelling piston 16 extends in the longitudinal direction along the whole inner diameter 18*a* of the levelling cylinder 18.

Along the circumferential surface of the inner diameter 18*a*, the levelling cylinder 18 comprises recesses 18*b* in the form of grooves 18*b*.

The grooves 18*b* begin in a certain distance from the longitudinal end of the inner diameter 18*a* and extend along a part of the longitudinal extension of the inner diameter 18*a*.

With regard to FIG. 1, each of the guiding elements 20 is provided with two balls respectively. Correspondingly, the grooves 18*b* comprise rounded ends or end stops which correspond to the guiding elements.

The piston 16*a* is formed with a central hole 16*a*.1 which extends through the piston 16 until a height, which corresponds to a starting/end point of the grooves along the inner diameter 18*a* of the levelling cylinder 18.

The central hole 16*a*.1 is also provided with a screw thread over at least a part of its whole length.

Furthermore, the piston 16*a* comprises receiving holes 16*a*.3 which are formed by a through hole at a height, which also corresponds to a starting/end point of the grooves along the inner diameter 18*a* of the levelling cylinder.

The guiding elements 20 in terms of balls 20 can be introduced to the piston via the central hole 16*a*.1 and transferred into the receiving holes 16*a*.3.

For this purpose, the central hole 16*a*.1 as well as the receiving holes 16*a*.3 are appropriately designed in consideration of the dimensions of the guiding elements 20.

In order to fix the levelling piston 16 to the rail vehicle body 12, a screw 13 is provided inside the ring-shaped layer spring. The screw 13 passes through the first fixation washer 24.1 into the central hole 16*a*.1 of the piston 16*a*.

Thus, only the single screw 13 is necessary to fix and center the levelling piston 16 appropriately.

Moreover, the screw 13 extends through the central hole 16*a*.1 and into the orthogonally oriented through hole which forms the receiving holes 16*a*.3.

In order to provide a sealing between the outer atmosphere and the inner diameter 18*a* of the levelling cylinder 18, the central hole 16*a*.1 comprises a piston seal 19 in contact with the screw.

Optionally, the piston seal 19 is provided along the circumferential surface of the central hole 16*a*.1 and in proximity to the receiving holes 16*a*.3.

Thus, a leakage of hydraulic fluid from the inner diameter 18*a* of the levelling cylinder 18 along the receiving holes 16*a*.3 and the central hole 16*a*.1 of the piston 16*a* can be prevented.

According to FIG. 1 the screw 13 thereby also positions the guiding elements 20 in the receiving holes 16*a*.3.

In particular, the two balls 20 of each guiding element 20 are pressed into the respective receiving holes 16*a*.3 by the screw 13.

Consequently, the guiding elements 20 protrude from the receiving holes 16*a*.3 of the piston 16*a* into the grooves 18*b* of the levelling cylinder 18.

In summary, each guiding element 20 is arranged between the screw 13, the piston 16*a*, in particular inside the receiving holes 16*a*.3, and the levelling cylinder 18, in particular inside the respective groove 18*b*.

Thus, the levelling piston 16, including the guiding elements 20, is capable of moving in a longitudinal direction of the levelling cylinder 18 along the grooves 18*b*.

The grooves 18*b* limit the maximal relative movement between the levelling cylinder 18 and the levelling piston 16 in combination with the protruding guiding elements 20.

According to the design of the at least one groove 18*b*, representing a recess 18*b* of the inner diameter 18*a* of the levelling cylinder 18, also a rotational movement of the levelling piston 16 can be enabled or prevented.

According to this first embodiment as illustrated in FIG. 1, the assembly of the levelling cylinder 18 and the levelling piston 16 essentially takes place as follows.

At first, the piston 16*a* is inserted into the levelling cylinder 18, namely into the inner diameter 18*a* of the levelling cylinder 18. Thus, the piston 16*a* is positioned inside the levelling cylinder 18 in a retracted state.

In a second operation, the guiding elements 20 are transferred to the receiving holes 16*a*.3 through the central hole 16*a*.1 of the piston 16*a*.

Afterwards, the screw 13 is screwed into the central hole 16*a*.1 comprising a corresponding thread. Thereby, the guiding elements 20 are positioned in the receiving holes 16*a*.3 such that they at least partially protrude from the piston 16*a* and into the grooves 18*b*.

Optionally, the screw 13 comprises a chamfered screw tip in order to achieve the final positioning of the guiding elements 20.

Further, a retaining washer 14 is provided between a screw head of the screw 13 and the first fixation washer 24.1.

Additionally, pins 15 are passing through the first fixation washer 24.1 into the piston 16*a*, parallel to the screw 13. Thus, a rotational movement of the levelling piston 16 relative to the first fixation washer 24.1 can be prevented.

Optionally, the piston 16*a* comprises maintenance bores (not illustrated in FIG. 1) through which the pins 15 can be pressed out and thus removed appropriately for the purpose of maintenance.

Figure 2:
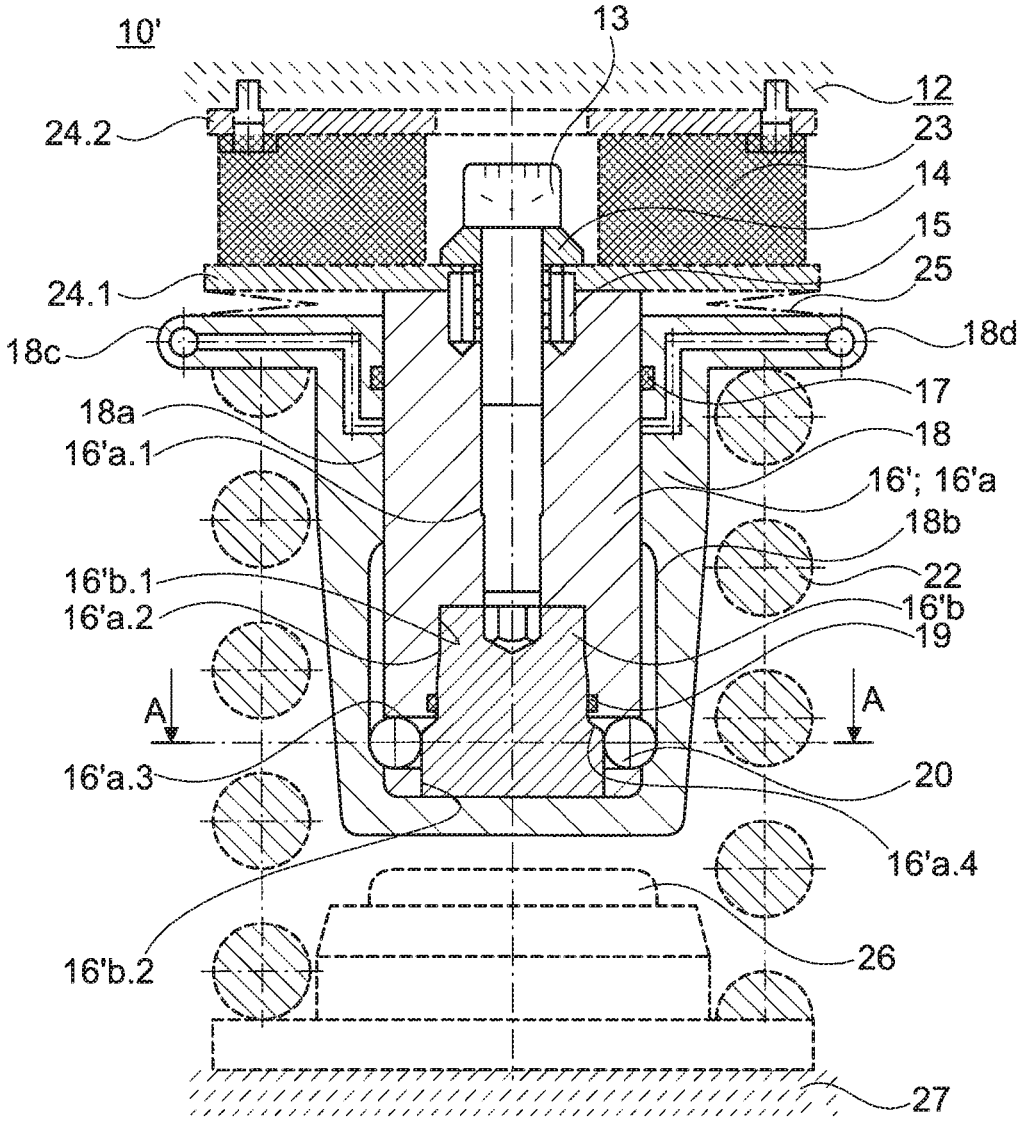
FIG. 2 a sectional view of a second embodiment of the levelling system according to the disclosed embodiments in a retracted state.

In FIG. 2 a sectional view of a second embodiment of a levelling system is illustrated in a retracted state.

The second embodiment according to FIG. 2 differs from the first embodiment according to FIG. 1 in particular with regard to the design of the levelling piston 16; 16'.

The levelling piston 16' as illustrated in FIG. 2 comprises a piston 16'*a* and a piston plug 16'*b* as well as guiding elements 20.

In case of FIG. 2, each guiding element 20 is represented by a single ball 20.

The piston 16'*a* comprises a piston plug hole 16*a*'.2 which is aligned with a central longitudinal axis of the piston 16'*a*.

Receiving holes 16'*a*.3 are provided in a comparable manner as outlined in the context of FIG. 1, namely at a height of the piston 16'*a*.3 which corresponds to the grooves 18*b* of the levelling cylinder 18 according to the retracted state.

Because of the plug hole 16'a.2, the receiving holes 16'a.3 are open in the piston 16'a to both sides and not connected to each other by a through hole anymore.

The piston plug 16'b is formed with at least a first outer circumference 16'b.1 and a second outer circumference 16'b.2.

In this regard, the piston plug 16'b and the plug hole 16'a are formed in a corresponding manner.

Along the first outer circumference 16'b.1 of the piston plug 16'b and the opposing inner circumference of the plug hole 16'a.2 corresponding threads can be provided respectively.

Thus, the piston plug 16'b can be screwed in the plug hole 16'a.2 in order to provide a screw connection with the piston 16'a.

In particular, the piston plug 16'b is completely insertable into the plug hole 16'a.2 of the piston 16a.

Between the first and second outer circumference 16'b.1; 16'b.2 an inclined chamfer 16'a.4 is provided as a transition area.

While the first outer circumference 16'b.1 is almost completely inserted into the plug hole 16'a.2, the second outer circumference 16'b.2 at least partially closes the receiving holes 16'a.3 from the inside of the plug hole 16'a.2.

At an inner circumference of the plug hole 16'a.2 and in proximity to the chamfer 16'a.4 between first and second outer circumference 16'b.1; 16'b.2 of the piston plug 16'b, the piston seal 19 is provided.

Thus, a leakage of hydraulic fluid from the levelling cylinder 18 through the plug hole 16'a.2 and the central hole 16'a.1 of the piston 16'a is preventable.

Additionally, the piston plug 16'b comprises a further central hole in extension of the central hole 16'a.1 of the piston 16'a such that the screw 13 or a specific tool can intrude into the piston plug 16'b.

Such a specific tool optionally provides a geometry that corresponds to the central hole of the piston plug 16'b in order to achieve a temporary form fit for a rotational movement.

In particular, the specific tool can be protruded through the central hole 16'a.1 of the piston 16'a into the central hole of the piston plug 16'b in order to screw in the piston plug 16'b or unscrew the piston plug 16'b from the plug hole 16'a.2.

According to this second embodiment as illustrated in FIG. 2, the assembly of the levelling cylinder 18 and the levelling piston 16' essentially takes place as follows.

At first, the piston plug 16'b is partially inserted into the plug hole 16'a.2 of the piston 16'a.

In particular, the piston plug 16'b, optionally comprising a suitable thread along the first outer circumference 16'b.1, can be partially screwed in the plug hole 16'a.

In a second operation, the guiding elements 20 can be inserted into the receiving holes 16'a.3 from the outside of the piston 16'a.

As long as the piston plug 16'b is only partially inserted in the plug hole 16'a.2, the guiding elements 20 do not protrude from the piston 16'a but are completely received within the receiving holes 16'a.3, in particular in combination with the first outer circumference 16'b.1 of the piston plug 16'b.

Auxiliarily, a tube can be temporarily used around to outside of the levelling piston 16' to keep the guiding elements 20 inside the receiving holes 16'a.3.

Afterwards, the levelling piston 16' is introduced into the levelling cylinder 18, in particular into the inner diameter 18a.

Subsequently, the piston plug 16'b can be finally and completely screwed in the plug hole 16'a.2 by a specific tool which is insertable through the central hole 16'a.1 of the piston 16'a and into the central hole of the piston plug 16'b.

Optionally, a form fit between the geometry of the specific tool and the central hole of the piston plug 16'b is provided.

By the piston plug 16'b being completely screwed in the plug hole 16'a.2, the second outer circumference 16'b.2 at least partially closes the receiving holes 16'a.3.

The inclined chamfer 16'a.4 of the piston plug 16'b ensures that the guiding elements 20 are adequately positioned in the receiving holes 16'a.3.

Thus, the levelling piston 16' with the piston 16'a, the piston plug 16'b and the guiding elements 20 is completed.

Moreover, the guiding elements 20 are respectively positioned inside the receiving holes 16'a.3 by the second outer circumference 16'b.2 of the piston plug 16'b and thus partially protrude from the piston 16'a.

The guiding elements or balls 20 are positioned between the second outer circumference 16'b.2 of the piston plug 16'b, the piston 16'a, namely inside the respective receiving holes 16'a.3, and the levelling cylinder 18, namely the corresponding grooves 18b.

Afterwards, the screw 13 is screwed in the central hole 16'a.1 comprising a corresponding thread.

Finally, the levelling piston 16' is positioned inside the levelling cylinder 18 in a retracted state.

A relative movement between the levelling piston 16' and the levelling cylinder 18, for providing an extended state of the levelling system, is enabled along the grooves 18b in combination with the partially protruding guiding elements 20.

Figure 3:
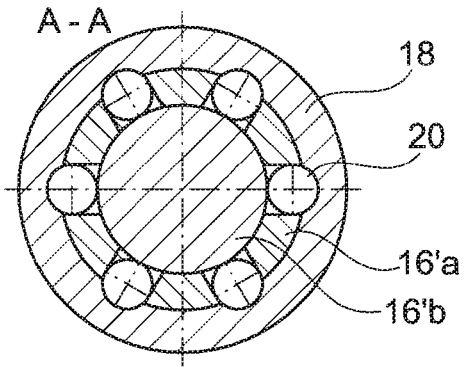
FIG. 3 a sectional view A-A of the second embodiment of the levelling system according to FIG. 2.

In FIG. 3 a sectional view A-A of the second embodiment according to FIG. 2 is shown.

The levelling cylinder 18 comprises the inner diameter 18a.

The inner diameter 18a provides circumferentially distributed grooves 18b. In particular, the levelling cylinder 18 according to FIG. 3 comprises a total amount of six grooves.

Thus, the single grooves 18b are separated from each other by an angle of 60° respectively, according to the second embodiment.

Further, the grooves 18b are formed in a corresponding manner with regard to the guiding elements or balls 20. In consequence, the balls 20 partially fits into the grooves 18b.

In particular, the balls 20 partially protrude from the piston 16'a into the grooves 18b.

The guiding elements or balls 20 are mainly positioned inside the respective receiving holes 16'a.3 and essentially carried by the piston 16'a.

Further, FIG. 3 illustrates that the piston plug 16'b, inserted in the plug hole 16'a.2, forces the guiding elements 20 to be appropriately positioned inside the respective receiving holes 16'a.3.

In consequence, the guiding elements 20 are forced to partially protrude form the piston 16'a and intrude into the grooves 18b.

The guiding elements or balls 20 are positioned between the piston plug 16'b, namely the second outer circumference 16'b.2, the piston 16'a, namely inside the receiving holes 16'a.3, and the levelling cylinder 18, namely the grooves 18b along the inner diameter 18a.

Thus, a translational movement of the levelling piston 16' relative to the levelling cylinder 18 is possible along the grooves 18b.

Moreover, FIG. 3 shows that a rotational movement between the levelling piston 16' and the levelling cylinder 18 is prevented by the guiding elements 20 partially intruding into the grooves 18*b*.

In summary, a relative movement between levelling cylinder 18 and levelling piston 16' is limited, particularly limited with regard to the concrete length and/or form of the grooves 18*b* along the inner diameter 18*a* of the levelling cylinder 18.

Figure 4:
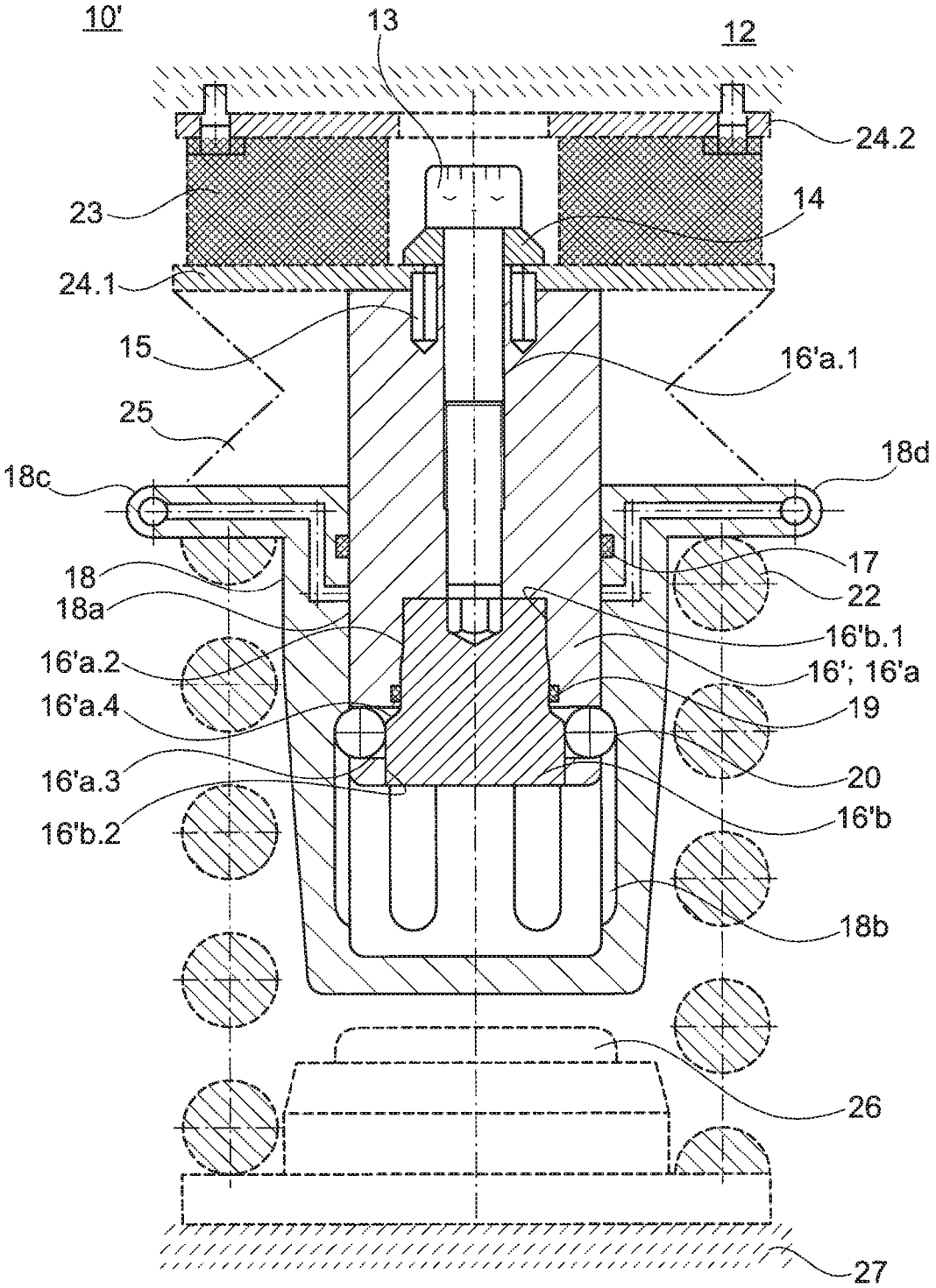
FIG. 4 a sectional view of the second embodiment of the levelling system according to the disclosed embodiments in an extended state.

FIG. 4 illustrates a sectional view of the second embodiment of the levelling system 10 in an extended state.

In contrast to FIG. 2, the levelling piston 16' is extended and relatively moved with respect to the levelling cylinder 18.

The guiding elements 20 are essentially carried by the piston 16'*a*, in particular in the receiving holes 16'*a*.3.

According to FIG. 4 the levelling piston 16'*a* with the guiding elements 20 is moved along the whole length of the grooves 18*b* of the levelling cylinder 18.

Thus, the guiding elements or balls 20 are shown at a longitudinal end stop of the grooves 18*b*.

Thus, FIG. 4 illustrates the maximal stroke which is provided by the second embodiment of the levelling system 10'.

The maximal stroke corresponds to the extension of the grooves 18*b* in the longitudinal direction of the levelling cylinder 18.

In summary, the disclosed embodiments represent an integrated construction in order to provide a space-saving embodiment as well as functional features in a simple and efficient way.

In general, the combination of guiding elements 20 and recesses 18*b*, in particular in terms of grooves 18*b*, allows to simultaneously provide a limitation of stroke movement as well as a corresponding end stop. Thus, the levelling piston 16; 16' cannot be removed from the levelling cylinder 18 during run time of the levelling system 10; 10', in particular because of the form fit optionally provided between the partially protruding guiding elements 20 and the correspondingly designed grooves 18*b*.

Moreover, the embodiment of the first and second hydraulic port 18*c*; 18*d* in a collar of the levelling cylinder 18 and their potentially tangential arrangement along the collar particularly necessitates to prevent any relative rotation between the levelling cylinder 18 and the levelling piston 16; 16'. Thus, a rotation lock between the levelling cylinder 18 and the levelling piston 16; 16' is desirable.

Such a rotational stop or lock is also provided by the disclosed embodiments with regard to the combination of guiding elements 20 and recesses or grooves 18*b*. In particular, in case of a design of the grooves 18*b* which corresponds to the protruding part of the guiding elements 20, a rotational movement of the levelling piston 16; 16' is prevented whereas a certain translational stroke movement in the longitudinal direction is enabled.

Consequently, the disclosed embodiments are able to provide an integrated construction of a levelling system 10; 10' with a longitudinal end stop for limitation of the stroke movement as well as a rotation lock.

REFERENCE SIGNS

10 Levelling system
10' Levelling system
12 Rail vehicle (body)
13 Screw
14 Retaining washer
15 Pin
16 Levelling piston
16*a* Piston
16*a*.1 Central hole
16*a*.3 Receiving hole
16' Levelling piston
16'*a* Piston
16'*a*.1 Central hole
16'*a*.2 Plug hole
16'*a*.3 Receiving hole
16'*a*.4 Chamfer
16'*b* Piston plug
16'*b*.1 First outer circumference
16'*b*.2 Second outer circumference
17 Cylinder seal
18 Levelling cylinder
18*a* Inner diameter
18*b* Recess/groove
18*c* First hydraulic port
18*d* Second hydraulic port
19 Piston seal
20 Guiding elements
22 Coil spring
23 Layer spring
24.1 First fixation washer
24.2 Second fixation washer
25 Bellow
26 Bump stop
27 Bogie

The invention claimed is:

1. A levelling system for a rail vehicle, the system comprising:

at least one levelling cylinder; and a levelling piston that is at least partially provided in each of the at least one levelling cylinders in a movable manner for setting a level of the rail vehicle, wherein the levelling system comprises at least one guiding element, which is arranged within the levelling piston and partially protrudes from the levelling piston into at least one recess of each of the at least one levelling cylinders such that an end stop in a longitudinal direction is provided for the relative movement between the levelling piston and each of the at least one levelling cylinders, wherein the levelling piston comprises a central hole which is formed such that the at least one guiding element is able to be passed through the levelling piston to be arranged within the levelling piston and partially protrude from the levelling system.

2. The levelling system of claim 1, wherein the at least one recess of each of the at least one levelling cylinders is formed as a groove extending on an inner diameter of each of the at least one levelling cylinders and along a part of the longitudinal extension of each of the at least one levelling cylinders.

3. The levelling system of claim 1, wherein the levelling piston comprises a piston and a piston plug, wherein the piston plug is arranged within the piston.

4. The levelling system of claim 3, wherein the piston comprises a plug hole at a longitudinal end side such that the piston plug is insertable into the piston.

5. The levelling system of claim 3, wherein the piston plug comprises at least a first outer circumference and a second outer circumference.

6. The levelling system of claim 5, wherein the at least one guiding element is provided between the piston of the levelling piston and the second outer circumference of the piston plug such that the at least one guiding element protrudes at least partially from the levelling piston into the at least one recess of wherein each of the at least one levelling cylinders.

7. The levelling system of claim 5, wherein the piston plug comprises an inclined chamfer, which forms a transition area between the first and second outer circumference.

8. The levelling system of claim 1, wherein the at least one guiding element is a ball or a pin.

9. The levelling system of claim 1, wherein the at least one guiding element forms a part of the longitudinal end stop for limitation of the stroke movement and/or a rotation lock for the levelling system.

* * * * *